United States Patent [19]

Boyd et al.

[11] 3,939,449

[45] Feb. 17, 1976

[54] INSULATED TRANSFORMER WINDINGS

[75] Inventors: Edward L. Boyd, Jefferson City; John P. McInerney, Hartsburg, both of Mo.

[73] Assignee: Westinghouse Electric Corporation, Pittsburgh, Pa.

[22] Filed: Jan. 15, 1975

[21] Appl. No.: 541,368

[52] U.S. Cl. ..... 336/60; 336/183; 336/206

[51] Int. Cl.[2] ..... H01F 27/08; H01F 27/32

[58] Field of Search ..... 336/60, 206, 55, 182, 183

[56] References Cited

UNITED STATES PATENTS

| | | | |
|---|---|---|---|
| 3,071,845 | 1/1963 | Leonard et al. | 336/60 X |
| 3,170,134 | 2/1965 | Palmer | 336/60 X |
| 3,201,728 | 8/1965 | McWhirter | 336/60 |
| 3,237,136 | 2/1966 | Ford | 336/60 |
| 3,708,875 | 1/1973 | Martineie et al. | 336/60 X |
| 3,774,298 | 11/1973 | Eley | 336/60 X |

*Primary Examiner*—Thomas J. Kozma
*Attorney, Agent, or Firm*—J. R. Hanway

[57] ABSTRACT

Distribution transformer having inner and outer low-voltage winding sections and a high-voltage winding section disposed therebetween. Insulation structures separate the various winding sections and include a relatively small thickness of solid insulating material and a liquid dielectric duct. Some of the solid insulating material is axially extended to increase the creep resistance of the winding. The insulation structures are also void of any metallic electrostatic shield or any other member which would hamper adequate processing of the insulation structure during the construction of the transformer.

4 Claims, 3 Drawing Figures

INSULATED TRANSFORMER WINDINGS

BACKGROUND OF THE INVENTION

1. Field of the Invention:

This invention relates, in general, to electrical inductive apparatus and, more specifically, to insulation structures for transformer windings.

2. Description of the Prior Art:

Electrical distribution transformers are usually manufactured in relatively large quantities on a production assembly line. The manner in which these transformers are constructed makes it desirable to have a transformer design which may be manufacutred on an assembly line in the shortest possible time. It has always been important to transformer engineers to design the insulation system of a transformer with this objective in mind.

The insulation system is important in controlling the transformed properties and the manufacturing time of distribution transformers. Enough insulation between the transformer winding turns and other components of the transformer must be provided to give the transformer the ability to withstand normal and overvoltage operating conditions and impulse voltages. However, the amount of insulation must be kept to a minimum amount possible in order to save space, material, and manufacturing time. Generally, more insulation in the transformers requires longer degassing and liquid dielectric impregnating cycles during construction. Consequently, it has always been the desire of transformer engineers to keep the amount of insulation in transformers, and in particular the thickness of the insulation, at a practicable minimum.

Various methods have been used to reduce the amount and thickness of insulation in transformers apart from any change in the composition of the insulating material itself. Devices or members which more evenly distribute the voltage stresses along or across the insulation structures have been used to permit more efficient use of the transformer insulation. Other types of grading or distributing arrangements have been used to shape the voltage stresses to change the insulation failure patterns between creep failure and puncture failure to achieve the greatest overall benefit of the insulation material contained within the transformer.

While the methods used to enhance the ability of the solid insulation to perform properly in a transformer system are numerous, almost universally it has been the tendency of transformer engineers to either increase the amount of insulation or change the voltage stress in a region where the insulation was known to be failing under actual field use or during laboratory testing. With either approach, the problems of complexity and economy are detrimentally affected. Therefore, it is desirable, and it is an object of this invention, to provide a transformer insulation structure which performs satisfactorily with a minimum of solid insulating material and stress grading or shaping members.

SUMMARY OF THE INVENTION

There is disclosed herein a new and useful distribution transformer winding structure which exhibits several advantages over prior art structures. The winding structure includes an inner low-voltage winding section, an outer low-voltage winding section, and a high-voltage winding section disposed therebetween. The conductors of the low-voltage winding sections are insulated from each other by layers of solid insulation. Similarly, the layers of conductors of the high-voltage winding section are insulated from each other by layers of solid insulation. The various winding sections are insulated from each other by winding-to-winding insulation structures positioned between the inner low-voltage winding section and the high-voltage winding section, and between the high-voltage winding section and the outer low-voltage winding section.

The winding-to-winding insulation structures contain a plurality of layers of solid insulation. The total thickness of these layers is substantially less than that of prior art winding-to-winding insulation structures. Some of the layers are axially extended to increase the creepage path between the low-voltage winding sections and the high-voltage winding section. An "all-around" duct is positioned in each of the winding-to-winding insulation structures to increase the insulation strength thereof and to improve the effectiveness of the sold insulation with normal manufacturing techniques.

Each of the winding-to-winding insulation structures is free of any metallic foil shield which is normally used according to the prior art with the intention of improving the effectiveness of the solid insulating material by better voltage stress distribution. The unique combination of elements in the winding-to-winding insulation structure allows the solid insulating material to perform economically as an insulator and permits the construction of high BIL distribution transformers with less solid insulating material than has been used according to the prior art.

BRIEF DESCRIPTION OF THE DRAWING

Further advantages and uses of this invention will become more apparent when considered in view of the following detailed description and drawing, in which.

DESCRIPTION OF THE PREFERRED EMBODIMENTS

Figure 1:
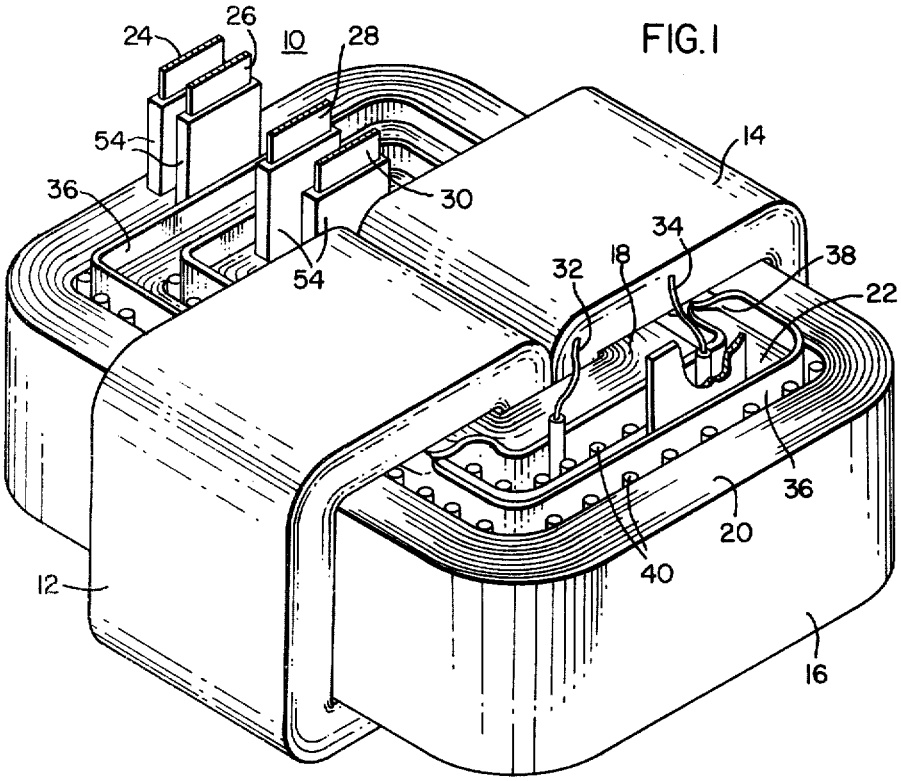
FIG. 1 is a view of a transformer core and winding assembly constructed according to this invention.

Throughout the following description, similar reference characters refer to similar elements or members in all of the figures of the drawing.

Referring to the drawing, and to FIG. 1 in particular, there is shown a transformer having a winding structure constructed according to this invention. The transformer 10 includes the magnetic cores 12 and 14 and the winding structure 16. The winding structure 16 is positioned in inductive relationship with the magnetic cores and includes an inner low-voltage winding section 18, an outer low-voltage winding section 20, and a high-voltage winding section 22. The low-voltage winding leads 24, 26, 28 and 30 are connected to the conductors within the inner and outer low-voltage winding sections, and the high-voltage winding leads 32 and 34 are connected to the conductors within the high-voltage winding section 22.

The conductors of the various winding sections are insulated from each other and from the conductors of adjacent winding sections by an arrangement of solid insulating members and liquid dielectric ducts. For example, the extended insulating member 36 provides part of the insulation between the high-voltage winding section 22 and the outer low-voltage winding section 20. The extended insulating member 36 projects axially beyond the boundaries of most of the other insulating members in the winding structure 16. The extended insulating member 36 is folded down upon the other insulating members at the positions where the insulating member 36 enters the opening in the magnetic core, such as at the position 38, to reduce the size of the magnetic core opening necessary to contain the winding structure 16.

The winding structure 16 includes liquid dielectric ducts which are formed by spacing members, such as the members 40, which extend through the insulation structure with the axis of the members 40 aligned substantially parallel with the axis of the winding structure 16. When the ducts which are formed by the members 40 extend around the entire circumference of the winding structure 16, they are known as "all-around" ducts. When the members 40 are positioned only in the portions of the winding structure 16 which extend from the magentic cores 12 and 14, the ducts are referred to as "end" ducts.

Figure 2:
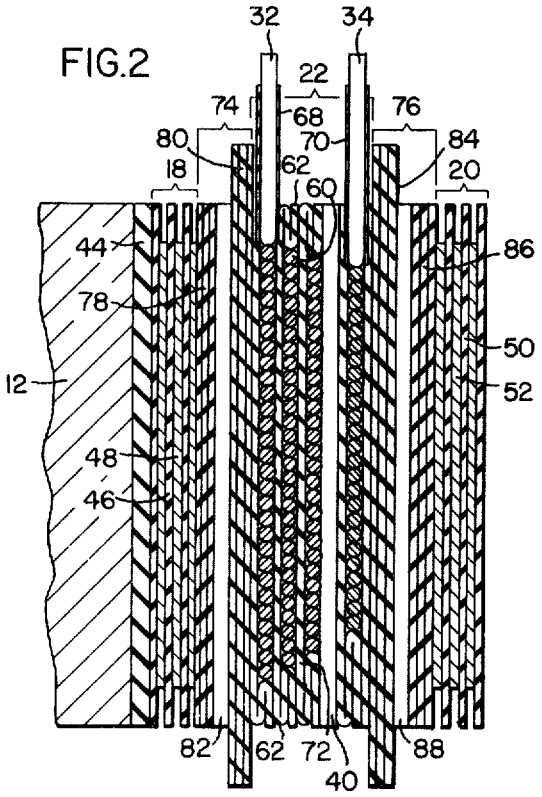
FIG. 2 is a cross-sectional view of the winding assembly shown in FIG. 1.

FIG. 2 is a cross-sectional view of the winding structure 16 illustrating the various layers of conductors, insulation, and liquid dielectric ducts used in the novel winding structure of this invention. The description of FIG. 2 will be better understood by referring to both FIGS. 1 and 2.

The inner low-voltage winding section 18 is positioned around a winding tube 44 which is adjacent to the magnetic core 12. While the thickness dimensions of the components of the winding structure 16 are not to be considered limiting to the scope of the invention as claimed herein, typical thicknesses will be indicated for the transformer 10 when having a rating of 150 KV BIL and 37.5 KVA, with a high-voltage winding rating of 34500 Grd Y/19920 volts and a low-voltage winding rating of 240/120 volts. With such ratings, the winding tube 44 would be constructed of 0.056 inch (1.42 millimeter) pressboard solid insulating material. The layer insulation 46 is positioned between the conductors 48 of the inner low-voltage winding section 18. The number of conductors 48 illustrated in the winding section 18 is less than that which would normally be used in order to simplify the drawing. The layer insulation 46 may be a suitable solid insulating material, such as treated kraft paper which is known commercially by the trademark "Insuldur."

The conductors 48 shown in FIG. 2 are foil or sheet conductors of a suitable electrical conducting material, such as copper or aluminum. In other embodiments of the invention, these conductors could be round wires or rectangular straps which are suitably insulated to withstand turn-to-turn voltages. For the transformer ratings specified herein, the thickness of the layer insulation 46 would be approximately 0.005 inch (0.127 millimeter). The layer insulation 46 extends axially beyond the edges of the conductors 48 to provide increased creepage insulation between adjacent conductors.

The outer low-voltage winding section 20 is constructed similar to the winding section 18. Thus, the layer insulation 50 is substantially the same as the layer insulation 46, and the electrical conductors 52 are substantially the same as the conductors 48. The winding leads 24, 26, 28 and 30, which are shown in FIG. 1, are not illustrated in FIG. 2 since they would normally be connected to the low-voltage winding sections at the other end of the winding structure than the end shown in FIG. 2. The insulating sleeves 54, which are also shown in FIG. 1, extend into the regions between the layer insulation 46 and 50 to provide insulation for the winding leads. The extension of the insulating sleeves 54 above the top of the extended insulating members insures that a sufficient creepage path will exist around the extended insulation 36. If the insulating sleeves 54 were not positioned in such a manner on the winding leads, it is possible that the winding lead could come into contact with the top edge of the extended insulating members, thereby decreasing the creepage path by approximately one-half that which would normally be provided when the low-voltage winding leads are not touching the extended insulating members.

The high-voltage winding section 22 includes a plurality of circular conductors 60 which are wound in a plurality of conductor layers throughout the high-voltage winding 22. The axial ends of the conductor layers in the high-voltage winding structure 22 progressively move farther away from the surface 62 of the insulating structure, thus providing a sufficient creep distance between the high-voltage conductor and the outer low-voltage winding conductor. The high-voltage winding section 22 also includes an end duct 40 which allows a liquid dielectric to flow through the winding section 22. The high-voltage winding leads 32 and 34 are also insulated by the sleeves 68 and 70 which also insure that the creepage path provided by the extended insulating members will be maintained even if the leads are pulled over against the extended insulating members.

For the transformer ratings described herein, the layer insulation 72 which is located between the high-voltage conductor layers would be approximately 0.025 inch (0.635 millimeter) thick and would be constructed of a suitable solid insulation material, such as that used for the layer insulation 46 and 50. The high-voltage layer insulation 72 includes "cuffs" at the ends thereof to aid the person winding the coil in maintaining the space between the surface 62 and the axial ends of the conductor, and to help provide mechanical support for the turns within the high-voltage winding 22.

The various winding sections are separated from each other by winding-to-winding insulation structures. More specifically, the inner low-voltage winding section 18 and the high-voltage winding section 22 are separated by the winding-to-winding insulation structure 74, and the low-voltage winding section 20 and the high-voltage winding section 22 are separated by the winding-to-winding insulation structure 76. The winding-to-winding insulation structures 74 and 76 are similarly constructed of solid insulating material and liquid dielectric ducts.

The winding-to-winding insulation structure 74 includes three layers 78 of 0.015 inch (0.381 millimeter) cellulosic paper, such as Insuldur, which is wrapped around the inner low-voltage winding section 18. The insulation structure 74 also includes a plurality of insulating layers 80, each of which is 0.015 inch thick and constructed of a material similar to that used for the insulating layers 78. Hence, in this specific embodiment, the total or aggregate thickness of the solid insulating material in each winding-to-winding insulation structure is only approximately three to five times the thickness of the layer insulation in the high-voltage winding structure. The layers 80 extend beyond the surface 62 of the insulating structure. An all-around duct 82 is positioned between the insulating layers 78 and 80 to permit cooling dielectric liquid to flow through the insulation structure 74, to increase the insulating strength of the insulation structure 74, and to permit satisfactory processing of the insulation structure 74 during the construction of the transformer.

The insulating layers 84 and 86, and the all-around duct 88 of the winding-to-winding insulation structure 76 are similar to the corresponding members in the insulation structure 74. The total or aggregate thickness of the winding-to-winding insulation structures 74 and 76 is sufficient to prevent any failure of the insulation structure due to puncture thereof caused by the voltage stresses developed therein. As will be discussed in more detail hereinafter, the relative thickness of the insulation structures 74 and 76 is much smaller than that of prior art arrangements.

Figure 3:
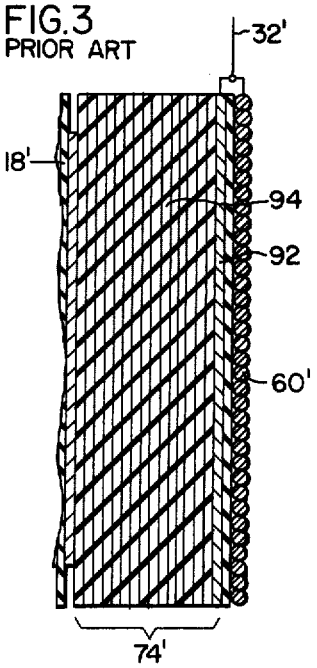
FIG.3 PRIOR ART
FIG. 3 is a partial cross-sectional view of a prior art winding assembly showing the winding-to-winding insulation structure.

FIG. 3 is a partial cross-sectional view of a winding insulation structure constructed according to the prior art. The inner low-voltage winding structure 18', the winding-to-winding insulation structure 74', the high-voltage winding conductors 60', and the high-voltage winding lead 32' perform substantially the same functions as the corresponding members in FIG. 2. However, as is clearly indicated by FIG. 3, the amount of solid insulating material contained within the winding-to-winding insulation structure 74' is much greater than the corresponding structure of this invention. In addition to the additional thickness of insulation, the winding-to-winding insulation structure 74' contains a static plate or electrostatic shield 92 which is constructed of a suitable conducting material, such as metallic foil or sheet. The shield 92 is connected to the lead 32' of the high-voltage winding for the purpose of more evenly distributing the voltage stresses across the insulation structure 74' upon the application of an impulse voltage to the high-voltage winding.

The arrangement of the insulation structure 74' shown in FIG. 3 is the result of years of insulation testing and analysis. When the BIL level of the transformer is sufficiently low, a reasonable thickness of the winding-to-winding insulation structure would normally provide the amount of insulation necessary to properly protect the winding structure. However, as the BIL level of transformers increased, it was found that additional dielectric strength was required between the low-voltage sections and the high-voltage winding section.

The obvious solution to a solid insulation breakdown problem is to either increase the amount of insulation, thereby decreasing the voltage stress on a particular segment of the insulation, and/or by changing the voltage stress field relative to the insulation structures to prevent any region of excessive voltage stress. Consequently, for the higher BIL levels, it was found necessary to place a shield, such as the shield 92, within the insulation structure 74' to evenly distribute the voltage stress along the axial length of the insulating layers 94 which are constructed of a suitable solid insulating paper such as Insuldur. In addition, it has been found that, to obtain satisfactory dielectric strength, the thickness of the insulation structure 74' must be increased proportionately more than the BIL level.

In a standard 150 KV BIL transformer presently constructed for commercial use, it has been found necessary to have an insulation thickness of approximately 0.32 inch (8.128 millimeters) for the insulation structure 74'. This is over sixty times the thickness of the layer insulation in the low-voltage winding section and approximately twelve times the thickness of the layer insulation in the high-voltage winding section. The use of such an amount of insulating material is considered disadvantageous for several reasons. The amount of solid insulating material required to construct the transformer is a significant portion of the cost of manufacturing the transformer. The additional radial build of the winding structure requires that the tank or enclosure which surrounds the core and winding assembly have larger dimensions, thus requiring more space and liquid dielectric. Also, more core and winding material is required. In addition, processing of the coil insulation is more complicated. It has been found that a considerable length of time must be used to degas and remove moisture from the insulating layers 94 to provide a winding-to-winding insulation structure which provides sufficient dielectric strength.

Referring again to FIG. 2, it can be seen that the winding-to-winding insulation structures 74 and 76 of the present invention are relatively less complicated and contain less material than the winding-to-winding insulation structure 74' shown in FIG. 3. In addition, the insulation structures 74 and 76 contain "all-around" liquid dielectric ducts, extended insulation above the surface of the insulation structure, and are free of any electrostatic shield. This unique combination of construction permits the insulation structures 74 and 76 to perform as well as the insulation structure 74' even without excessive moisture and gas elimination procedures during the construction of the transformer.

The arrangement of components according to this invention, as shown in FIG. 2, are contrary to the conventional beliefs of what is necessary to improve the puncture resistance of winding-to-winding transformer insulation structures. For example, electrostatic shields adjacent to the high-voltage windings are placed in the insulation structure for the purpose of improving the stress distribution of the insulating members to permit the insulation to satisfactorily handle the voltage stress or, as is sometimes the case, to permit a reduction in the solid insulating material while still providing adequate dielectric strength. Thus, when insulation failure due to puncture is prevalent, the removal of any stress shaping shield would seem contrary to the accepted practices used by transformer engineers. In addition, when the dielectric strength of the solid insulating material is not sufficient to prevent failure due to puncture, the natural tendency is to increase the amount of insulation in order to increase the dielectric strength across the aggregate of the insulating layers. Therefore, without hindsight, the development of the winding-to-winding insulation structures 74 and 76 shown in FIG. 2 runs contrary to what has conventionally been considered as obvious solutions to an insulation problem.

The winding-to-winding insulation structures 74 and 76 shown in FIG. 2 are believed to provide adequate insulating properties because of several reasons. First of all, the elimination of the shield eliminates an impregnable barrier which herebefore has prevented the proper degassing and demoisturizing of the solid insulating materials during construction of the transformer. Thus, many failures herebefore regarded as a result of insufficient thicknesses of solid insulating material have been caused by a poor dielectric strength for the total insulating structure due to improper and insufficient elimination of moisture and gases from the solid insulating material. The processing of the solid insulating materials is also compounded, according to the thick prior art arrangements, by the bulk or thickness of the insulating material. Thus, reducing the amount of solid insulating material as shown in FIG. 2 allows the degassing and demoisturizing processes to more adequately remove the foreign contaminants from the insulating structure, thereby insuring that the dielectric strength is substantially a linear relationship between the amount of solid insulating material used. In addition, the elimination of the shield, which, being constructed of a thin conductive foil, usually develops folds and wrinkles when wound into the coil, allows the elimination of the stress concentrations occurring at the sharp edges of the folds and wrinkles.

The all-around ducts 82 and 88 between the insulating layers also enhance the ability of the solid insulating material to expel its contaminants during the manufacturing process. The all-around ducts also provide a degree of insulation between the winding sections by the mere separation of the winding sections, without increasing the amount of solid insulating material.

Since the radial distances between the high-voltage winding section and the outer low-voltage winding sections decrease with a decrease in thickness of the insulating structures 74 and 76, it is necessary to increase the creepage paths between the electrical elements of these structures to maintain adequate electrical insulation. This is provided by the extension of the insulating layers 80 and 84 beyond the surface 62 of the insulating structure. Thus, the creepage paths traverse the extended sides and tops of the extended insulation layers of the insulation structures 74 and 76.

The resulting insulation structures 74 and 76 use solid insulating members whose aggregate thickness is not much greater than the thickness of the insulating layers between the various conductors and is much less than the aggregate thickness of solid insulation herebefore used, use extended layers of insulation to provide adequate creepage resistance, use dielectric ducts to assure adequate processing of the solid insulating materials and to provide an overall reduction in the stress gradient on the insulating structures, and avoid the use of any other member which would trap moisture or gases within the solid insulating material which would degrade the dielectric strength thereof.

Since numerous changes may be made in the above described apparatus, and since different embodiments of the invention may be made without departing from the spirit thereof, it is intended that all of the matter contained in the foregoing description, or shown in the accompanying drawing, shall be interpreted as illustrative rather than limiting.

We claim as our invention:

1. A transformer comprising;

a magnetic core structure;

an inner low-voltage winding structure having conductor layers disposed in inductive relationship with the magnetic core, said winding structure including at least one layer of a solid insulating material between each of said conductor layers;

a high-voltage winding structure having conductor layers disposed around the outside of the inner low-voltage winding structure, said winding structure including at least one layer of a solid insulating material between each of said conductor layers;

a first winding-to-winding insulation structure disposed between the inner low-voltage winding and the high-voltage winding structures;

an outer low-voltage winding structure having conductor layers disposed around the high-voltage winding structure, said winding structure including at least one layer of a solid insulating material between each of said conductor layers; and a second winding-to-winding insulation structure disposed between the high-voltage winding and the outer low-voltage winding structures;

said first and second winding-to-winding insulation structures each having ducts which permit the flow of liquid dielectric through the insulation structure, having layers of a solid insulating material which extend axially beyond the axial ends of all of the layered insulating material in all of said winding structures, and not having a conventional metallic foil electrostatic shield which extends substantially the entire axial length of the high-voltage winding structure.

2. The transformer of claim 1 wherein the ducts in the winding-to-winding insulation structures extend around the entire circumference of the insulation structures.

3. The transformer of claim 1 wherein the first and second winding-to-winding insulation structures each contain a plurality of layers of a solid insulating material, with the aggregate thickness of the solid insulating material in each insulation structure being less than five times greater than the a layer of thickness of the insulation in the high-voltage winding structure.

4. The transformer of claim 1 wherein the winding-to-winding insulation structures contain a plurality of layers of a solid insulating material, with the aggregate thickness of the solid insulating material being greater than a first predetermined thickness which prevents breakdown of said insulation before the breakdown of any other insulation in the transformer upon the application of an impulse voltage, and being less than a second predetermined thickness which is sufficiently thick to trap a significant amount of moisture within the insulation structure.

* * * * *